US007828615B2

(12) United States Patent
Bonis et al.

(10) Patent No.: US 7,828,615 B2
(45) Date of Patent: Nov. 9, 2010

(54) AMPHIBIOUS SHOE AND METHOD OF USE

(76) Inventors: Carrie L. Bonis, P.O. Box 100, Martinsville, NJ (US) 08836; Kostanteno Bonis, P.O. Box 100, Martinsville, NJ (US) 08836

( * ) Notice: Subject to any disclaimer, the term of this patent is extended or adjusted under 35 U.S.C. 154(b) by 0 days.

(21) Appl. No.: 12/799,057

(22) Filed: Apr. 16, 2010

(65) Prior Publication Data

US 2010/0203779 A1 Aug. 12, 2010

(51) Int. Cl.
*A63B 31/11* (2006.01)

(52) U.S. Cl. ..... 441/61; 441/64

(58) Field of Classification Search ..... 441/61–64; D21/806

See application file for complete search history.

(56) References Cited

U.S. PATENT DOCUMENTS

| | | | | |
|---|---|---|---|---|
| 1,533,659 | A * | 4/1925 | Nilsson | 441/60 |
| 1,627,521 | A | 5/1927 | Menschel | 441/61 |
| 1,688,498 | A | 10/1928 | Jacobsen | 441/62 |
| 1,702,681 | A | 2/1929 | Barbosa | 441/62 |
| 2,980,926 | A * | 4/1961 | Wolshin | 441/64 |
| 4,250,584 | A | 2/1981 | Korn | 441/61 |
| 4,599,071 | A * | 7/1986 | Juang | 441/64 |
| 4,752,259 | A | 6/1988 | Tackett et al. | 441/64 |
| 5,041,039 | A | 8/1991 | Chang | 441/64 |
| 5,108,327 | A | 4/1992 | Klein | 441/62 |
| 5,429,536 | A * | 7/1995 | Evans | 441/64 |
| 5,447,457 | A | 9/1995 | Kamitani | 441/64 |
| 5,879,212 | A | 3/1999 | Kennedy | 441/64 |
| 5,924,902 | A | 7/1999 | Burns et al. | 441/64 |
| 6,155,898 | A | 12/2000 | Burns et al. | 441/64 |
| 6,241,567 | B1 * | 6/2001 | Evans | 441/64 |
| 6,247,982 | B1 | 6/2001 | Walker | 441/64 |
| 6,540,574 | B2 | 4/2003 | Hashizume et al. | 441/64 |
| 6,543,097 | B2 * | 4/2003 | Burt et al. | 24/170 |
| 7,159,336 | B2 | 1/2007 | Burns et al. | 36/8.1 |

FOREIGN PATENT DOCUMENTS

| | | |
|---|---|---|
| FR | 2565498 | 12/1985 |
| SU | 995825 | 2/1983 |

* cited by examiner

*Primary Examiner*—Ed Swinehart
(74) *Attorney, Agent, or Firm*—Ernest D. Buff & Associates LLC; Ernest D. Buff; Margaret A. LaCroix

(57) ABSTRACT

An amphibious shoe has a sole with a fin compartment integrated therein retractably houses of a lightweight fin that converts the shoe from a walking shoe to a swimming shoe. The amphibious shoe includes a fin comprising ridges intermittent between material arranged in an accordion construction. The fin is capable of being ejected from the compartment and expanded to a fan configuration. The shoe is further provided with a pivotal stabilizing strap for enhanced stability during swimming. In one embodiment the fin is removed by a release button in communication with a spring. Other embodiments provide for manual deployment by pulling on the fin from the fin compartment. In operation, the wearer can comfortably run or walk swiftly along the land as the integrated fin has a thin lightweight construction. Upon reaching the water's edge, the shoe is readily converted for swimming by ejecting and positioning the fin.

16 Claims, 13 Drawing Sheets

AMPHIBIOUS SHOE AND METHOD OF USE

BACKGROUND OF THE INVENTION

1. Field of the Invention

The present invention relates to an amphibious shoe for swimming and walking; and more particularly, to an amphibious shoe having a sole with a fin compartment integrated therein that houses a lightweight retractable fin which is deployed to convert the shoe from a walking to a swimming shoe.

2. Description of the Prior Art

Increased propulsion and maneuverability in water during diving, swimming, and snorkeling is typically achieved by utilizing fins. However, applying fins on land and walking into the water can be difficult, causing the person to trip and fall. Even still, carrying fins onto the beach or water's edge can be cumbersome, especially if other items also need to be hauled.

Amphibious shoe devices have been provided that utilize a separate mountable fin appointed to be removably attached to a shoe for swimming. Mountable fin devices pose significant problems, including time consuming attachment processes and burdensome carrying of the flipper. During walking, debris will easily lodge into screw holes, or other attachment means, clogging or damaging same so that attachment of a fin would become further aggravating, if not impossible. For example, U.S. Pat. No. 5,041,039 to Chang discloses an amphibious shoe including a shoe having a fastening plate at its front end for connection with a diving flipper.

Several swim shoes have been provided that utilize a rotatable fin attached or mounted on an exterior portion of a shoe construct. For example: U.S. Pat. No. 1,533,659 to Nilsson discloses a swimming device having one or more, and preferably two rectangular frames located in a spaced parallel relation running horizontal along the wearer's leg and having their inner members secured to a carrying element, and teaches a strap near the toes of the foot extending through an aperture in order to hold the shoe in place on a wearer's foot; U.S. Pat. No. 1,627,521 to Reinhold discloses a shoe having a laterally pivoting aluminum frame; U.S. Pat. No. 1,702,681 to Barbosa discloses a sandal/shoe with a blade structure hingedly attached to the side of the shoe; U.S. Pat. No. 4,250,584 to Korn discloses a collapsible swim fin; U.S. Pat. No. 4,752,259 to Tackett et al. discloses a rotatable two-part fin; U.S. Pat. No. 5,108,327 to Klein discloses a retractable rotating swim fin; U.S. Pat. Nos. 5,429,536 and 6,241,567 to Evans disclose a monofin comprising a swim blade having two adjustable foot pockets for attachment to the feet of a swimmer, and a non-mold method of forming articles, such as a swim fin; U.S. Pat. No. 5,447,457 to Kamitani discloses a pivoting swim fin; U.S. Pat. No. 5,879,212 to Kennedy discloses a rotatable blade (swim fin); U.S. Pat. No. 5,924,902 to Burns et al. discloses a shoe-like structure fused to a foldable one-piece continuous sole-fin; U.S. Pat. No. 6,155,898 to Burns et al. discloses a fin blade that rests adjacent to a wearer's instep; U.S. Pat. No. 6,247,982 to Walker discloses a rotatable fin; U.S. Pat. No. 6,540,574 to Hashizume et al. discloses a foldable diving flipper; U.S. Pat. No. 7,159,336 to Burns et al. discloses an improved amphibious shoe with a folding swim fin; and Foreign Publication No. FR 2565498 A1 to Vielle discloses a sandal having a rotatable flexible paddle. These external foldable fins, propellers, or blades are hingedly or bendableyy attached to the exterior of the shoe in a vertical orientation for walking and rotated to a horizontal orientation for swimming. External positioning of the fin structure exposes the rotatable fin to damage and poses tripping problems as the fin readily snags on objects while the wearer is walking. Further, the external fin mounted on the shoe causes the shoe to appear aesthetically gaudy if the wearer exits the beach to walk on the boardwalk, or other proximate locations.

Strap type devices have been provided in the art for fastening portions together. For example U.S. Pat. No. 6,543,097 to Burt, et al. discloses a slide fastening device for sports article including two portions adapted to be brought closer together having a strap, one end of which is connected to a first portion of the sports article, which passes in a return connected to a second portion of the sports article. However, these types of fastening/support devices are not appointed to rotate in a pivotal fashion in order to provide enhanced support and cannot provide adequate support for a fin structure.

Various swim shoes have been provided wherein a pivoting propeller or swim blade is laterally integrated within the heel or back of the sole of a shoe. These propellers or blades generally operate to pivot from an axis located in the heel of the shoe so that the blades do not act as fins in the front of the shoe, but instead engage as propeller blades on either side of the back of the shoe. When deployed, the propeller blades do not act as a fin construct as there are spaces between the blades, which are not as effective as a fin during swimming. For example: U.S. Pat. No. 1,688,498 to Jacobsen discloses a swimming shoe wherein a device having pivoting propeller blades is appointed to be attached to the soles of a shoe so that propeller blades pivot outwardly from the heel of the shoe to operate as pedals.

Even where swim shoes have been provided with swimming propellers, fins or blade integrated within a cavity stowed in the front portion of a sole of a shoe, these swim shoes fail to provide stabilization means that operate in conjunction with the fin to prevent buckling of the fin or loss of the shoe during swimming. The frontward integrated swim shoes heretofore disclosed and utilized are generally constructed as sandals with instep straps, toe straps, and a heel strap with a retractable fin, failing to provide enhanced stabilization means during swimming. Other disclosed embodiments only provide a clog-like shoe structure, lacking heel supports altogether. For examples: U.S. Pat. No. 2,980,926 to Wolshin discloses a swimming appliance or fin shoe that contemplates a shoe similar to a beach sandal which is provided with an extensible fin having a plurality of relatively flexible ribs connected by integral flexible webbing which expands when pulled forward from the shoe and contracts when pulled back into the shoe; U.S. Pat. No. 4,599,071 to Juang discloses an adjustable beach shoe having a platform and straps, as a sandal, wherein peripheral walls of the platform are formed with a first cut-out on the front end for admitting a web to pass through, so that when the web is pulled out and held between the sole and the platform at the front end of the platform, the shoes can be used as a diving flipper; and Foreign Publication No. SU 995825 to Berman et al. discloses footwear for swimming including a shoe portion having a fin housed therein.

None of the water-land shoes heretofore disclosed provides an amphibious shoe having a sole with a compartment therein for housing a fin or fin forming blade structure, which further provides enhanced stabilization means for comfort and securement of the shoe during swimming. Such a construct would provide an amphibious shoe that can readily be manipulated from a walking configuration to a swimming configuration, while activating stabilization means for providing enhanced stability of the shoe during swimming.

There remains a need in the art for an amphibious shoe having a lightweight fin portion internally integrated therein for immediate access to facilitate conversion from a walking shoe to a swimming shoe. Further needed is an amphibious shoe having enhanced stabilizing means integrated therein for superior operation of the fin and stabilization of the shoe during swimming as water is propelled to-and-fro against the fin.

SUMMARY OF THE INVENTION

The present invention provides an amphibious shoe having a lightweight fin portion internally integrated therein for immediate access to facilitate conversion from a walking shoe to a swimming shoe. The amphibious shoe is further provided with enhanced stabilizing means integrated therein for superior operation of the fin and stabilization of the shoe during swimming as water is propelled to-and-fro against the fin. The amphibious shoe's construction functions to require minimal manipulation of the shoe, so that the wearer does not have to remove the shoe or carry any obtuse fin parts.

In a first embodiment of the amphibious shoe comprises a sole including a fin aperture, top wall, back wall, and a bottom wall constructed to form a fin compartment integrated therein. A fin is housed within the fin compartment in a retracted position. The fin is adapted to be ejected from the compartment when desired. The fin comprises ridges intermittent between a material sheet, and is arranged in an accordion construction so that the fin is capable of being expanded to a fan configuration. Compression of the fin in the fan configuration reduces the fin to a compact configuration when the fin is appointed to be retracted back into the fin compartment in the sole. A pivotal stabilizing strap assembly is further attached to the shoe. The pivotal stabilizing strap assembly is adapted to hold the fin in place on a wearer's foot. This pivotal stabilizing strap operates to pivot and rest against the wearer's foot, providing enhanced stability of the fin and shoe during swimming.

In one embodiment, the fin is removed by way of a release button in communication with a spring. Other embodiments provide for manual deployment by the operator by pulling on the fin from the fin compartment. In operation, the wearer can comfortably run or walk swiftly along the land as the integrated fin has a thin lightweight construction. Upon reaching the water's edge, the wearer can readily convert the shoe for swimming by simply ejecting and positioning the fin.

The method of using the amphibious shoe includes the steps of: (i) wearing a shoe appointed with a sole including a fin aperture, top wall, back wall, and a bottom wall constructed to form a fin compartment integrated therein, and having a pivotal stabilizing strap assembly, wherein a fin is housed within the fin compartment in a retracted position and comprises ridges intermittent between a material and is arranged in an accordion construction, so that the fin is capable of being expanded to a fan configuration, and can be compressed from the fan configuration to a compact configuration when the fin is appointed to be retracted back into the fin compartment in the sole; (ii) adjusting the shoe for swimming by ejecting the fin from the fin compartment; (iii) expanding the fin into the fan configuration; (iv) pivoting the pivotal stabilizing strap assembly for securing the fin in place to provide enhanced stability during swimming; (v) swimming with the fin; and (vi) compressing the fin back to the retracted position and pressing the fin back into the fin compartment when swimming is completed and walking is desired.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

This invention relates to an amphibious shoe having a lightweight fin portion internally integrated therein for immediate access for conversion from a walking shoe to a swimming shoe. The amphibious shoe is further provided with enhanced stabilizing means integrated therein for superior operation of the fin, and stabilization of the shoe during swimming as water is propelled to-and-fro against the fin. The amphibious shoe provides a shoe capable of being worn to the beach or water's edge, and which provides a fin that becomes readily accessible in response to (i) activation of a tab in communication with a spring, (ii) pulling of the fin in the compartment, or (iii) pulling of a tab and sliding the fin forward.

In operation of the amphibious shoe, the wearer can comfortably run or walk swiftly along the land and across the beach to a location near or in the water as the fin integrated within the shoe is lightweight and thin in construct so that it is not readily felt by the wearer's foot. Accordingly, the amphibious shoe's construction functions to require minimal manipulation of the shoe, so that the wearer does not have to remove the shoe or carry any obtuse fin parts. Retraction of the fin allows immediate use of the fin, while at the same time the amphibious shoe provides a stabilizing strap assembly for enhanced operation of the fin during swimming in steadying the fin and shoe on the wearer's foot as water is propelled to-and-fro against the fin. As a result, the amphibious shoe stays on the wearer's foot and the fin does not deform or otherwise bend as water forces are applied to the fin during swimming.

Figure 1A:
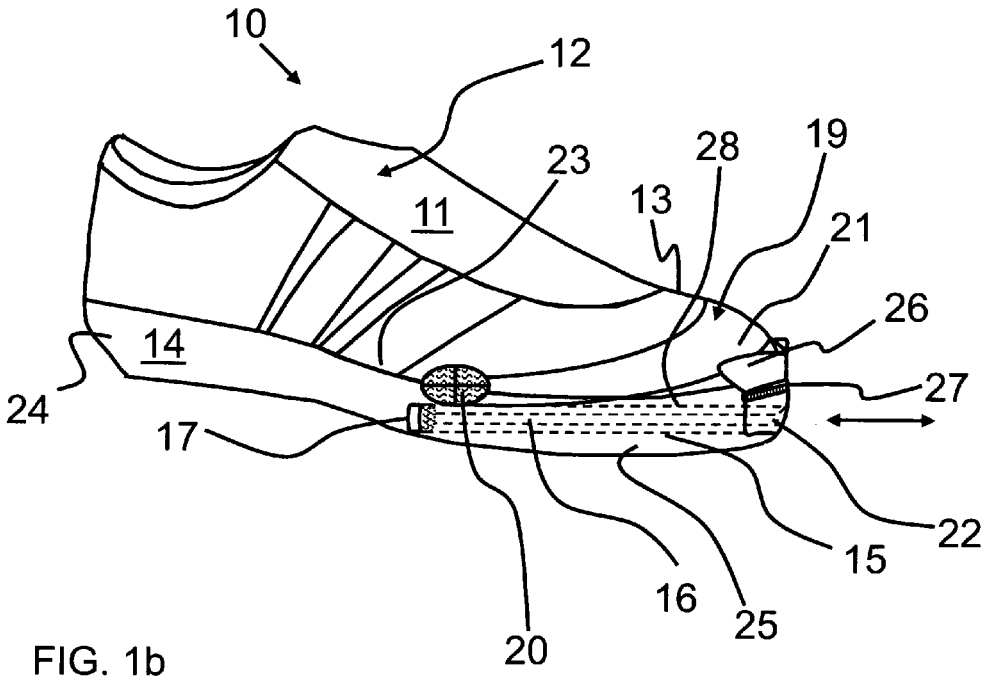
FIG. 1*a* is a top side view of an embodiment of the amphibious water shoe wherein the shoe is a mesh water shoe or sneaker and a fin is in the retracted position housed in a compact configuration within a fin compartment in the shoe's sole.
Figure 1B:
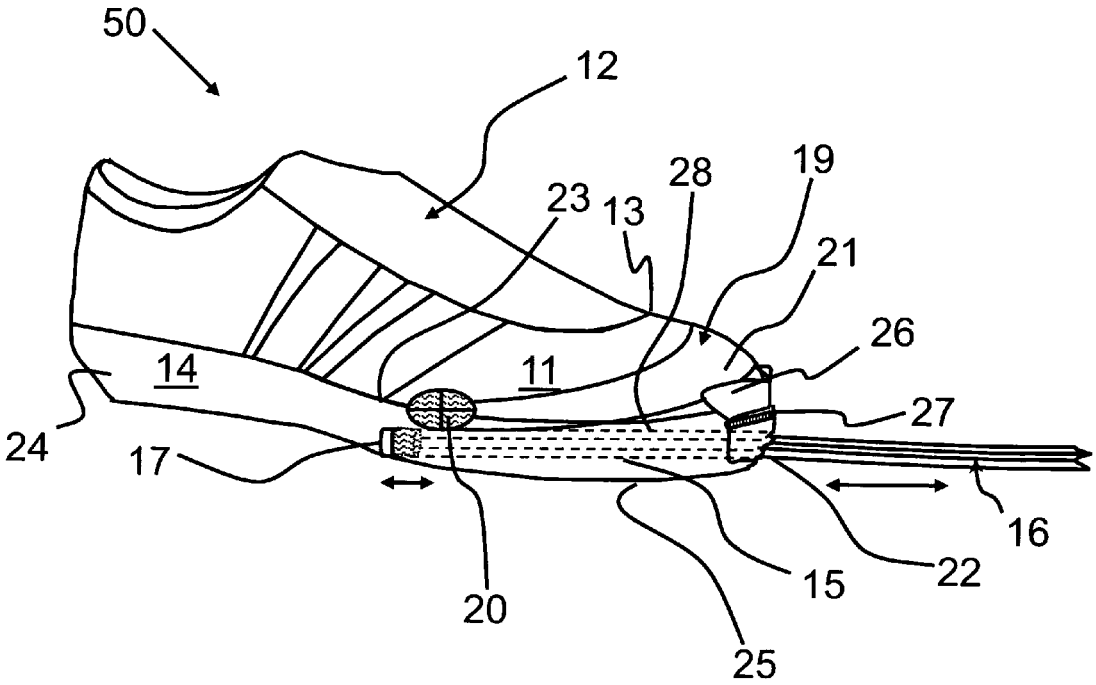
FIG. 1*b* shows a top side view wherein the fin is in the ejected position and in the compact configuration.
Figure 1C:
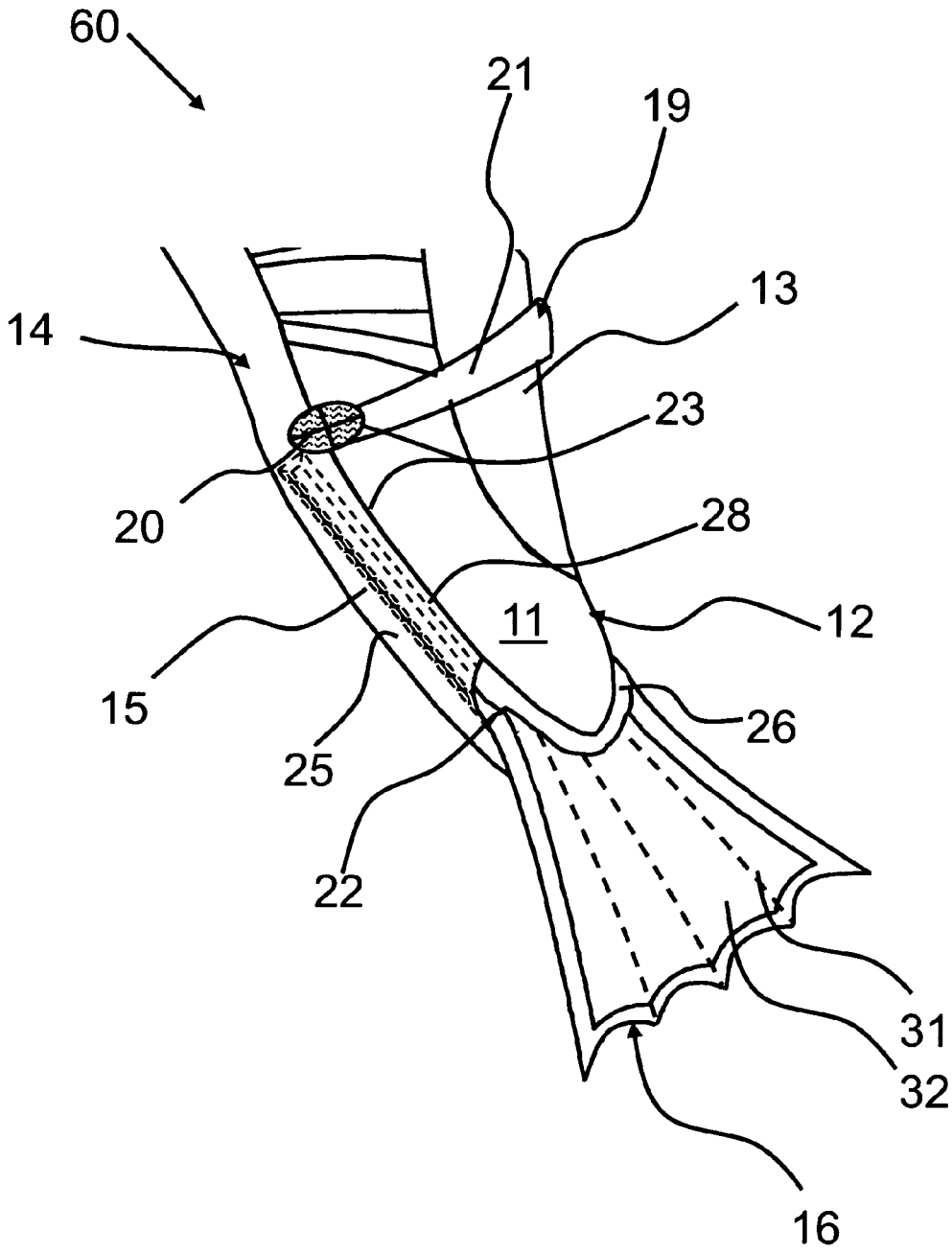
FIG. 1*c* shows a top side view wherein the fin is in the ejected position and in the fan configuration.

FIGS. 1*a*-1*c* illustrate a first embodiment of the amphibious shoe wherein the shoe is of a slip on shoe/sandal having a generally mesh construct typical of those worn in the water. Particularly: FIG. 1*a* illustrates a top side view wherein the fin is in the retracted position being housed within the fin compartment of the sole, shown generally at 10; FIG. 1*b* illustrates a top side view wherein the fin is in the ejected position and in the compact configuration, shown generally at 50; and FIG. 1*c* illustrates a top side view wherein the fin is in the ejected position and in the fan configuration, shown generally at 60. Amphibious shoe 11 comprises a shoe 12, herein shown as a mesh shoe that is typically worn in the water by swimmers, but may be of any type of shoe, sneaker, or sandal. Shoe 12 includes a shoe housing 13, herein shown as a top of a shoe and arch and heel portions, and a sole 14 constructed with a fin aperture 22, top wall 23, back wall 24, and a bottom wall 25 constructed to form a fin compartment 15 integrated therein. Fin aperture 22 may further include an aperture cover 26, which is preferably pivotally attached to fin aperture 22 by way of a hinge 27 or thin flexible strip so that aperture cover 26 can be opened to access fin aperture 22 when getting ready for ejecting a fin 16 housed within fin compartment 15 and closed to prevent debris and sand from entering fin aperture 22 when walking. Fin 16 is housed within fin compartment 15 in sole 14 in a retracted position. Fin 16 is capable of manual deployment in a number of ways. Embodiments discussing the deployment are set forth hereinafter in reference to FIGS. 2-5. Deployment is preferably achieved through manual pulling of fin 16 from compartment 15 (see FIGS. 2*a*, 2*b*). In another embodiment, deployment of fin 16 is achieved by sliding a release tab along a track in the sole of the shoe (see FIGS. 3*a*-3*c*). In yet another embodiment, deployment is achieved by way of a spring release in association with a tab (see FIGS. 4*a*-4*b*). Herein, a release button/tab 17 is shown in generally, which is in communication with fin 16 for effectuating deployment/ejection of fin 16 from sole 14 through said fin aperture 22 in an ejected position as shown in FIGS. 1*b* and 1*c*.

Fin 16 comprises ridges 31 intermittent between a material 32 and arranged in an accordion construction so that fin 16 is capable of being extended to a fan configuration as shown in FIG. 1*c* when fin 16 is appointed to be utilized in water. Conversely, fin 16 is compressed to a compact configuration shown in FIG. 1*b* when fin 16 is appointed to be retracted back through fin aperture 22 into fin compartment 15 in sole 14. Ridges 31 are preferably composed of metal, but may be composed of a polymeric material. Ridges 31 preferably have a thickness ranging from 0.02 inches to 0.25 inches. Material 32 is preferably a lightweight mesh material. Alternatively, material 32 is composed of a lightweight thin rubber sheet material. The plurality of ridges 31 provides strength and rigidity to fin 16. Material 32 between ridges 31 is a lightweight mesh material.

Sole 14 is constructed slightly thicker than a typical sole for accommodation of fin 16. Sole 14 of shoe 12 preferably has a thickness ranging from 0.25 inches to 3 inches for accommodating fin 16. Sole 14 may include a transitional cushion 28 located within top wall 23 of sole 14 above fin compartment 15 to further enhance comfort to the wearer's foot by mitigating the ability of the wearer to feel the fin 16 when walking or running. Transitional cushion 28 may be composed of a memory foam, foam, fibrous cushion, or gel like cushion.

A pivotal stabilizing strap assembly 19 is attached at the front of shoe 12 appointed for holding fin 16 in place on a wearer's foot and operates to pivot and rest against the wearer's foot to provide enhanced stability of fin 16 and shoe 12 during swimming. In one embodiment, pivotal stabilizing strap assembly 19 includes a pivot bolt 20 attached to shoe housing 13 and a pivoting strap 21 so that pivotal stabilization strap assembly 19 is pivotally attached to a front portion of shoe 12, up near the toe region, and operates to pivot and rest against a top part of the wearer's foot. In operation, strap 21 pivots back toward the person's ankle or top bridge of the foot. A lock member is provided on pivot bolt 20 to lock strap 21 in place on the top of the foot. Preferably, pivotal stabilization strap assembly 21 comprises a tension mechanism. The tension mechanism may be a locking mechanism, such as a tension buckle, or preferably may be provided by composing strap 21 of an elastic band material and appointing an adjustment buckle thereon, so that after strap 21 is pivoted to rest on the bridge of the foot it is tightened by way of the adjustment buckle. Strap 21 may be a soft polymeric material and may have a concave shape to mirror the top bridge of the foot so that it snuggly hugs the top bridge of the foot when resting thereon and locked via locking mechanism means (such as locking fasteners or the like). In an alternative embodiment, the pivotal stabilization strap assembly may be longer and flexible for stretching behind the person's heels (see discussion in FIG. 5).

Figure 2A:
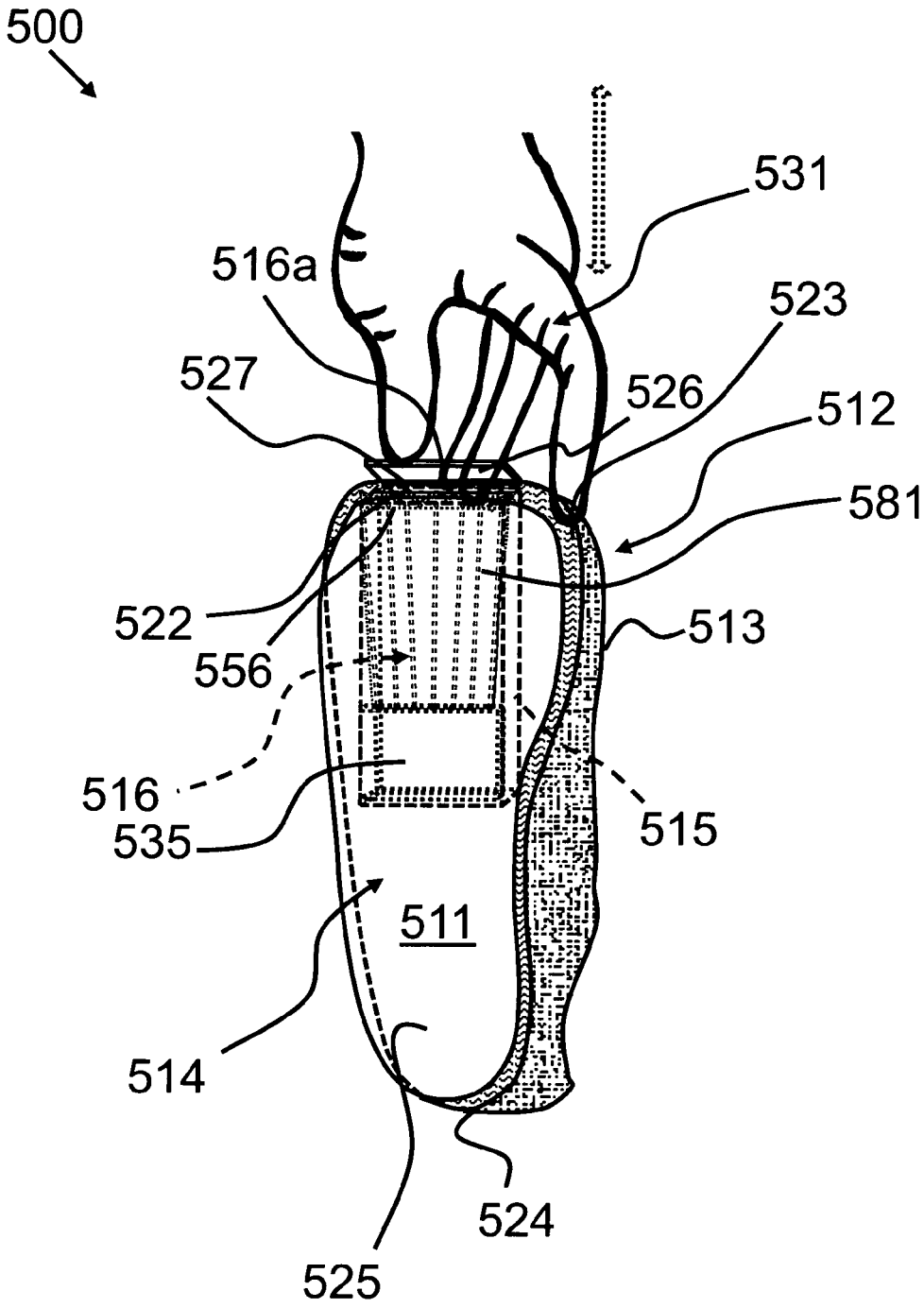
FIGS. 2*a*-2*b* illustrate an embodiment of the amphibious water shoe wherein the fin is manually deployed or moved to the ejected position by a user pulling on a portion of the fin.
Figure 2B:
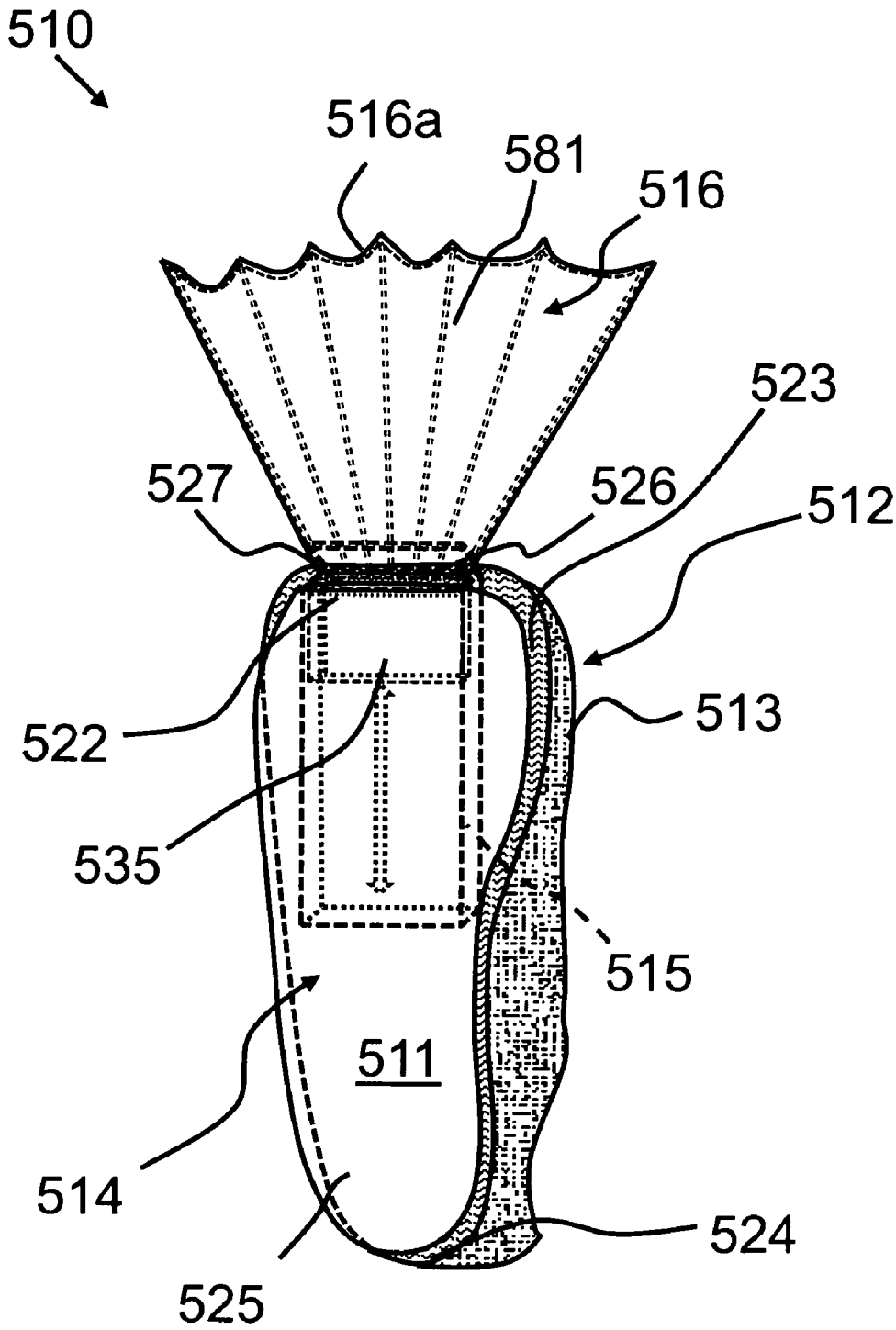

FIGS. 2*a*-2*b* illustrate an embodiment of the amphibious water shoe wherein the fin is manually deployed or moved to the ejected position by a user pulling on a portion of the fin. FIG. 2*a* illustrates the fin in the retracted position housed within the fin compartment of the sole, shown generally at 500; and FIG. 2*b* illustrates a top side view wherein the fin is in the ejected position, shown generally at 510. Amphibious shoe 511 comprises a shoe 512, herein shown as a mesh shoe that is typically worn in the water by swimmers, but may be of any type of shoe, sneaker, or sandal. Shoe 512 includes a pivot strap (not shown), shoe housing 513, herein shown as a top of a shoe and arch and heel portions, and a sole 514 constructed with a fin aperture 522, top wall 523, back wall 524, and a bottom wall 525 constructed to form a fin compartment 515 integrated therein. Fin aperture 522 may further include an aperture cover 526, which is preferably pivotally attached to fin aperture 522 by way of a hinge 527 or thin flexible strip so that aperture cover 526 can be opened to access fin aperture 522 when getting ready for ejecting a fin 516 housed within fin compartment 515 and closed to prevent debris and sand from entering fin aperture 522 when walking.

Fin 516 is housed within fin compartment 515 in sole 514 in a retracted position. Discussion as to the construct of the fin and pivot is set forth hereinabove with regards to the discussion of FIG. 1, and FIGS. 6*a*, 6*b* hereinafter. In the embodiment shown in FIGS. 2*a*, 2*b*, fin 516 is capable of manual deployment achieved through pulling of the fin 516 from compartment 515. Fin 516 is housed in fin compartment 515 and is accessible by way of fin aperture 522 at 516*a*. In operation, a user opens aperture cover 526 and grabs onto fin 516 at tip/or portion 516*a* with his/her fingers 531. While grasping portion 516*a* of fin 516 with his/her fingers 531, the user pulls fin 516 forward and out of fin compartment 515. Fin 516 is constructed having flexible ridges 581 that operate to automatically expand or fan out, when fin 516 is ejected. A block 535 is connected to fin 516 and moves forward within the fin compartment 515 to release fin 516 therefrom. Block 535 abuts with fin aperture 522. Fin aperture 522 is preferably smaller in size than block 535 so that block 535 does not exit fin compartment 515. Block 535 remains in fin compartment 515 at all times, lest the fin 516 would be completely removed from compartment 515, which would be undesirable. Aperture 522 and/or block 535 may include a rubber gasket 556 to further provide a substantially water tight fin compartment, a smooth fin 516 ejection, and to mitigate any side-to-side wobbling movement of the fin 516 during swimming.

Figure 3A:
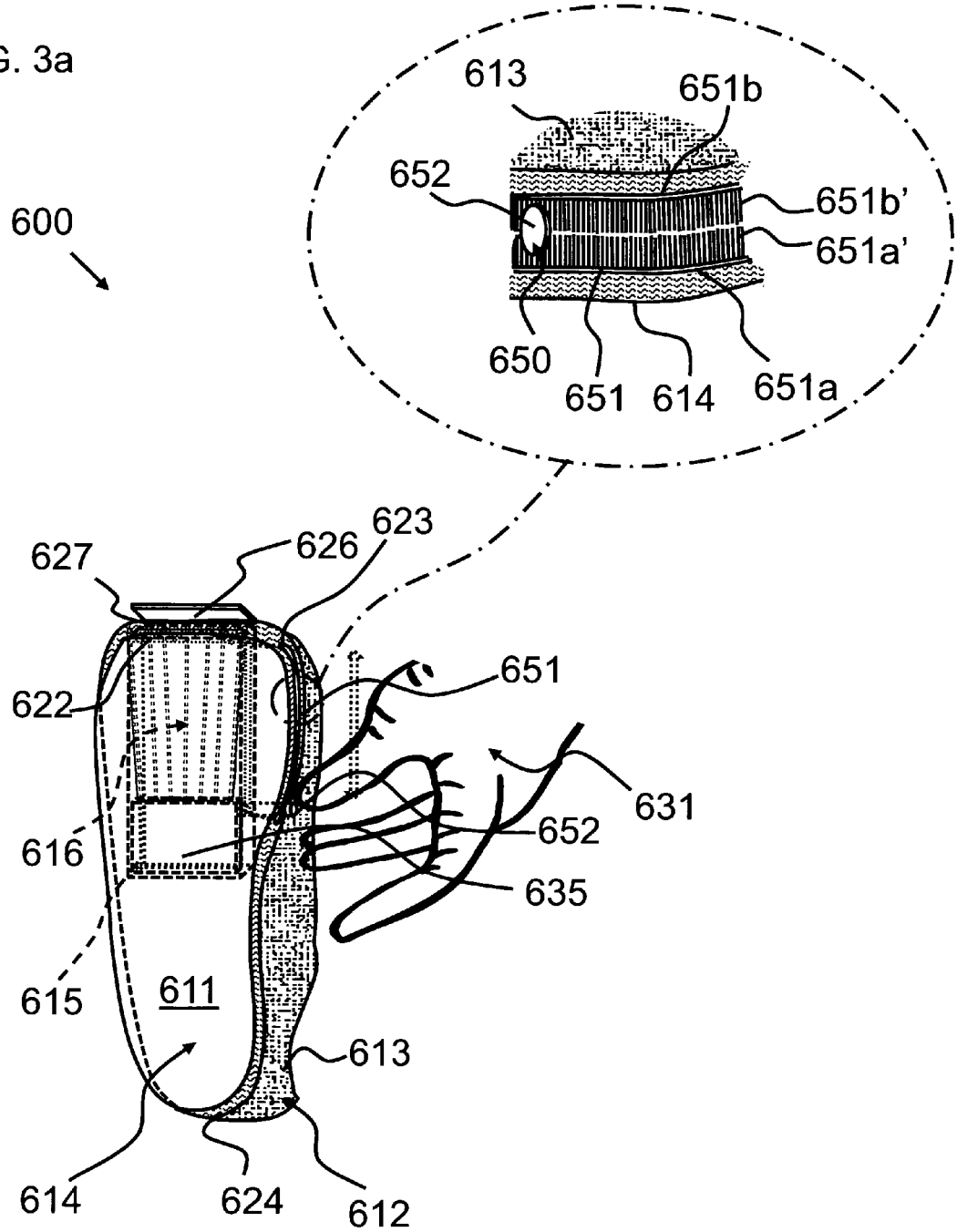
FIGS. 3*a*-3*c* illustrate an embodiment of the amphibious water shoe wherein the fin is manually deployed or moved to the ejected position by a user sliding a release knob/release tab in communication with a portion of the fin.
Figure 3B:
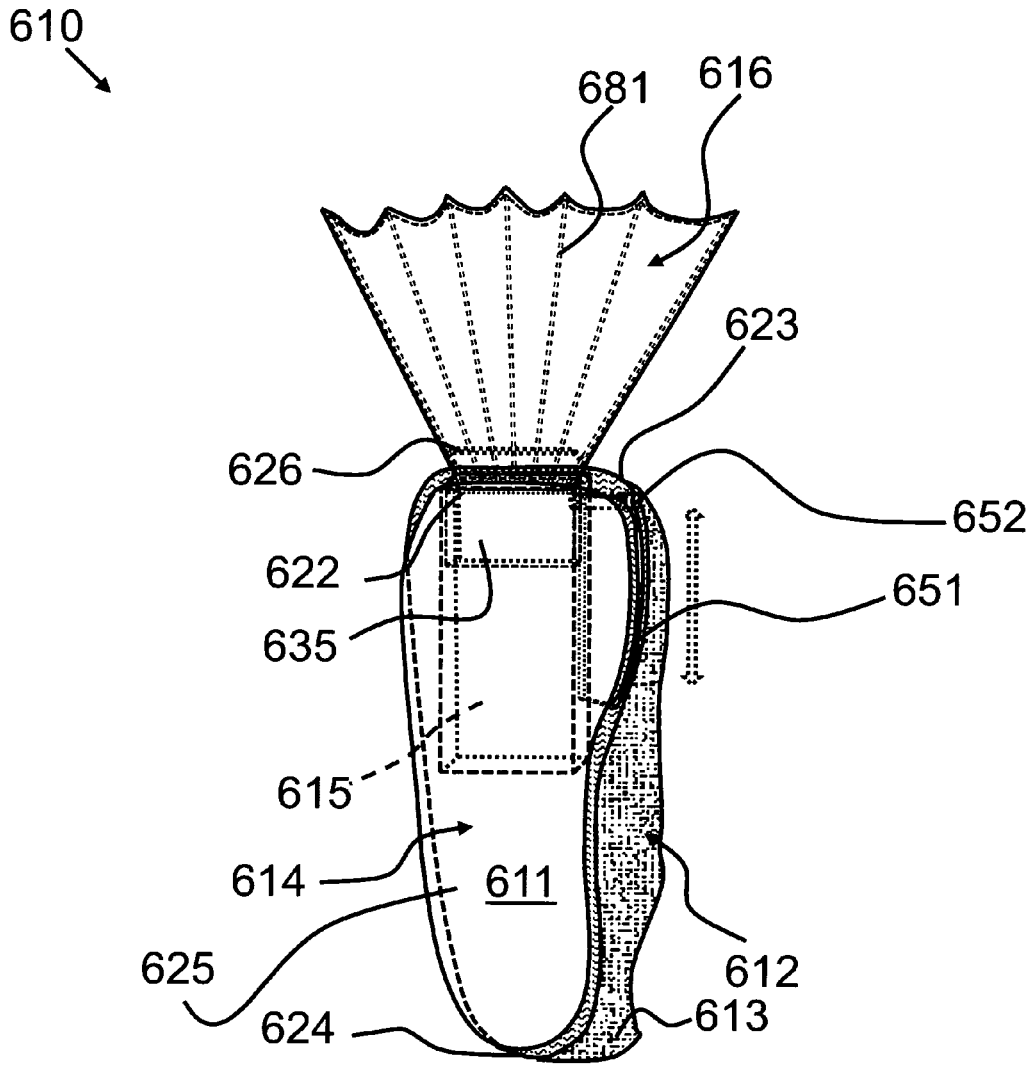
Figure 3C:
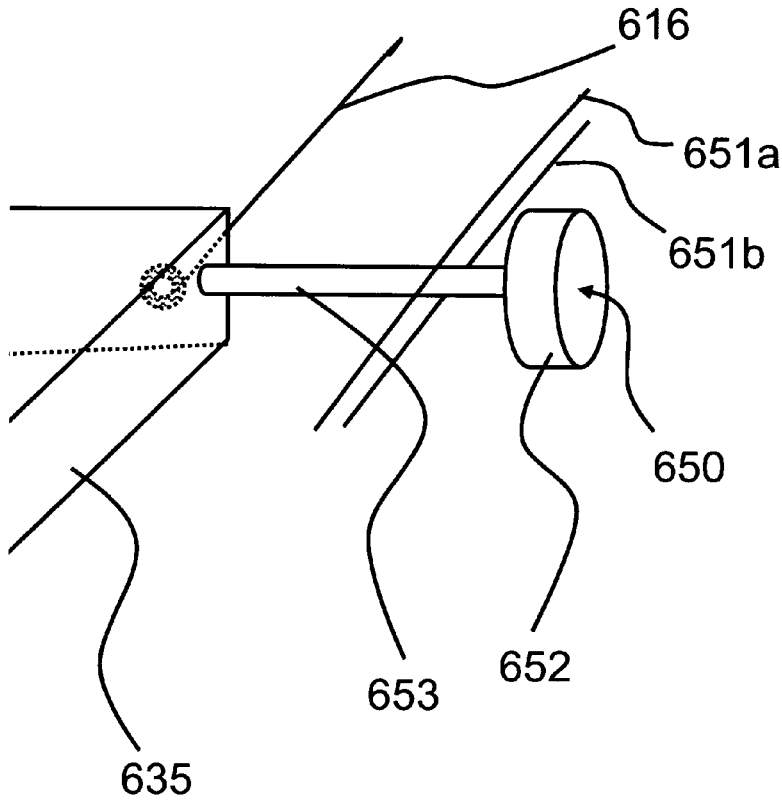

FIGS. 3*a*-3*c* illustrate an embodiment of the amphibious water shoe wherein the fin is manually deployed or moved to the ejected position by a user sliding a release knob/release tab in communication with a portion of the fin. FIG. 3*a* illustrates the fin in the retracted position housed within the fin compartment of the sole, shown generally at 600; FIG. 3*b* illustrates a top side view wherein the fin is in the ejected position, shown generally at 610; and FIG. 3*c* illustrates a cross-sectional exploded view of an embodiment of the release knob/release tab. Amphibious shoe 611 comprises a shoe 612 constructed having shoe housing 613, sole 614 constructed with a fin aperture 622, top wall 623, back wall 624, and a bottom wall 625 constructed to form a fin compartment 615 integrated therein, and a pivot strap (not shown). Fin aperture 622 may further include an aperture cover 626, which is preferably pivotally attached to fin aperture 622 by way of a hinge 627 or thin flexible strip so that aperture cover 626 can be opened to access fin aperture 622 when getting ready for ejecting a fin 616 housed within fin compartment 615 and closed to prevent debris and sand from entering fin aperture 622 when walking.

Fin 616 is housed within fin compartment 615 in sole 614 in a retracted position. Discussion as to the construct of the fin and pivot is set forth hereinabove with regards to the discussion of FIG. 1, and FIGS. 6*a*, 6*b* hereinafter. In the embodiment shown in FIGS. 3*a*, 3*b*, and 3*c*, fin 616 is capable of manual deployment achieved through slide tab/sliding release tab movement of the fin 616 from compartment 615. Fin 616 is constructed having flexible ridges 681 that operate to automatically expand or fan out, when fin 616 is ejected. A block 635 is connected to fin 616 and moves forward within the fin compartment 615 to release fin 616 therefrom. Block 635 has a size and shape larger than fin aperture 622 so that block 635 abuts fin compartment 615 at aperture 622 when fin 616 is ejected for swimming.

In the embodiment shown, amphibious shoe 611 further comprises a sliding release tab 650 and a tab slot 651 in sole 614 of shoe 612. Tab slot 651 runs parallel to the bottom of sole 614 and is preferably formed of a flexible polymeric slot. Tab slot 651 extends from the exterior of sole 614 to fin compartment 615 and generally runs slightly less in length than the length of fin compartment 615. Sliding release tab (see FIG. 3*c*) is formed having a tab end 652 appointed to be grasped by fingers 631 connected to a shaft 653 that abuts and is fixed to block 635 carrying fin 616. Shaft 653 extends and runs upon tab slot 651. Tab slot 651 is constructed having shallow parallel walls 651*a*, 651*b*. Preferably shallow parallel walls 651*a*, 651*b* include a debris shield for mitigating entry of debris within the tab slot 651. Preferably shallow parallel walls 651*a*, 651*b* each include a plurality of flexible bristle-like elements 651*a*', 651*b*' forming the debris shield as shown in the exploded view at 670, that are composed of a plurality of flexible polymeric, rubber, silicone, hair material, etc., shafts that readily bend and flex to part as shaft 653 runs along shallow parallel walls 651*a*, 651*b* of tab slot 651. Flexible bristle-like elements 651*a*', 651*b*' are provided to facilitate a more even movement of shaft 653 along tab slot 651, as well as aid in preventing debris from entering slot 651 so that there is no interruption of the mechanical operation of sliding release tab 650 along tab slot 651. These flexible bristle-like elements 651*a*', 651*b*' facilitate in preventing debris, such as sand, rocks and sticks, from entering and becoming lodged in slot 651 and/or fin compartment 615. Alternatively, shallow parallel walls 651*a*, 651*b* each include a flexible rubber gasket/or shallow rubber/silicon/foam/fibrous wall that flexi when shaft 653 runs along it (not shown).

In operation, a user opens aperture cover 626 and grabs onto tab end 652 with his/her fingers 631. While grasping tab end 652 with his/her fingers 631, the user slides tab end 652 horizontally along tab slot 651. As tab end 652 moves forward along tab slot 651 shaft 653 runs along tab slot 651 and block 635 fixed thereto moves forward in fin compartment 615. As a result, fin 616 moves forward and out of fin compartment 615. As fin 616 is constructed having flexible ridges 681 that operate to automatically expand or fan out, when fin 616 is ejected it yields a usable swim fin.

Figure 4A:
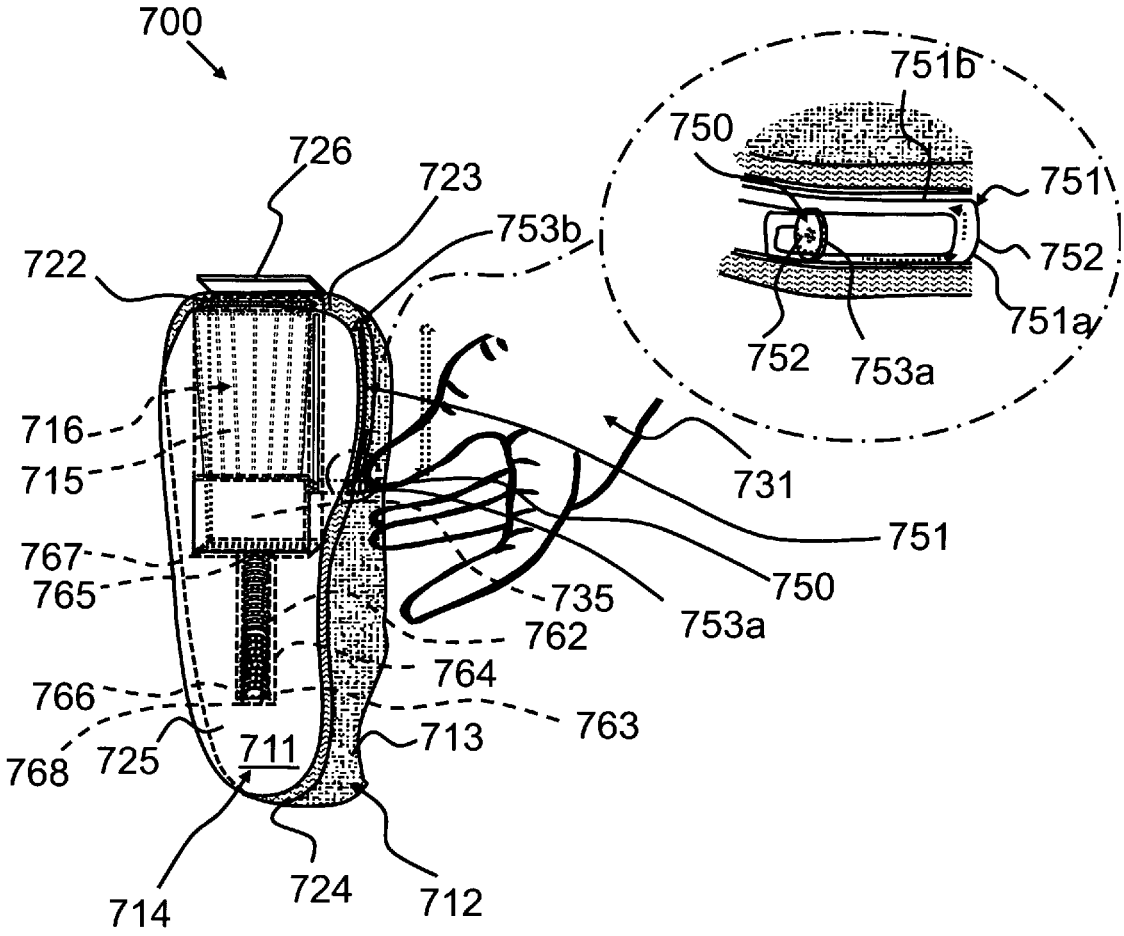
FIGS. 4*a*-4*b* illustrate an embodiment of the amphibious water shoe wherein the fin is deployed or moved to the ejected position by way of a release tab in communication with a spring.
Figure 4B:
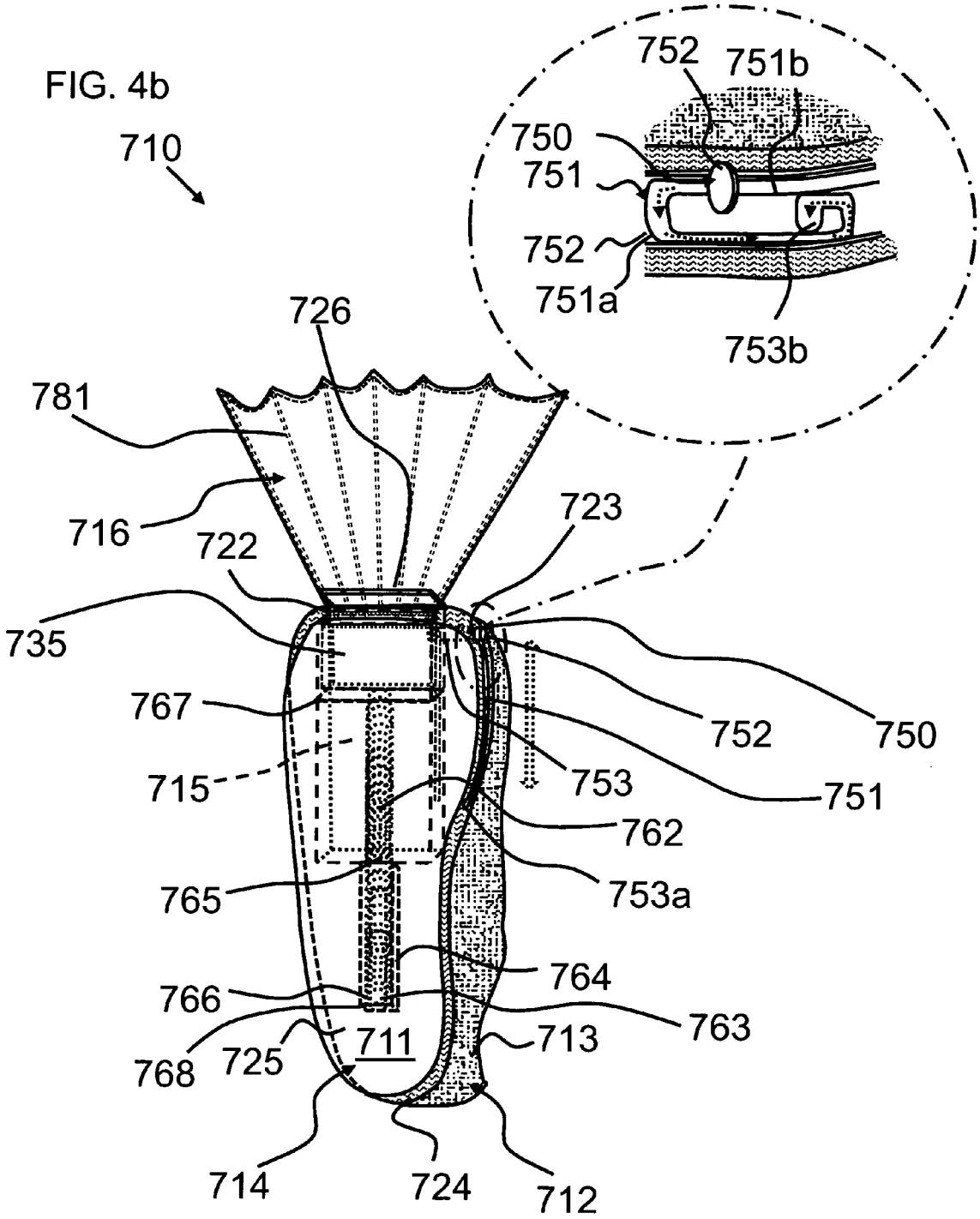

FIGS. 4*a*-4*b* illustrate an embodiment of the amphibious water shoe wherein the fin is deployed or moved to the ejected position by way of a release tab in communication with a spring. FIG. 4*a* illustrates the fin in the retracted position housed within the fin compartment of the sole, shown generally at 700; and FIG. 4*b* illustrates a top side view wherein the fin is in the ejected position, shown generally at 710. Amphibious shoe 711 comprises a shoe 712 constructed having shoe housing 713, sole 714 constructed with a fin aperture 722, top wall 723, back wall 724, and a bottom wall 725 constructed to form a fin compartment 715 integrated therein, and a pivot strap (not shown). Fin aperture 722 may further include a aperture cover 726 to prevent debris and sand from entering fin aperture 722 when walking.

Fin 716 is housed within fin compartment 715 in sole 714 in a retracted position. Discussion as to the construct of the fin and pivot is set forth hereinabove with regards to the discussion of FIG. 1, and FIGS. 6*a*, 6*b* hereinafter. Fin 716 is housed in fin compartment 715 and is accessible by way of fin aperture 722. Fin 716 is constructed having flexible ridges 781 that operate to automatically expand or fan out, when fin 716 is ejected. A block 735 is connected to fin 716 and moves forward within the fin compartment 715 to release fin 716 therefrom. Block 735 has a size and shape larger than fin aperture 722 so that block 735 abuts fin compartment 715 at aperture 722 when fin 716 is ejected for swimming.

In the embodiment shown, amphibious shoe 711 further comprises a release tab 760 in communication with a spring 762 preferably movable on an axis rod 763 fixed in a secondary rod compartment 764 that forces the fin 716 from the fin compartment 715. Spring 762 has a distal end 765 and a proximal end 766. Distal end 765 is preferably fixedly attached to a base plate 767 that presses against block 735. Proximal end 766 is preferably fixed to a back wall 768 of secondary rod compartment 764. Axis rod 763 is also preferably fixedly attached to back wall 768 and spring 762 circumferentially surrounds axis rod 763 and is free to travel to and fro along axis rod 763 when the spring 762 expands and contracts. Further provided is a horizontal slot 751 having shallow parallel side walls 751*a*, 751*b* that include u-shaped curved ends 752*a*, 752*b* terminating at a ball slot 753. Horizontal tab slot 751 runs parallel to the bottom of sole 714 and is preferably formed of a flexible polymeric/rubber/silicone slot. Release tab 760 is formed having a tab end 752 appointed to be grasped by fingers 731 connected to a shaft 753 that abuts and is fixed to block 735 carrying fin 716. Shaft 753 extends and runs upon horizontal tab slot 751.

In operation, a user opens aperture cover 726 and grabs onto tab end 752 with his/her fingers 731 and releases tab end 752 from ball slot 753*a*. Removal of release tab end 752 from ball slot 753 causes release of spring 762 which is in the coiled condition in FIG. 4*a*. Spring 762 expands along axis rod 763 and pushes base plate 767 forward. In turn, base plate 767 presses against block 735 carrying fin 716 and forces block 735 and visa vie fin 716 forward to through compartment 715. As spring 762 causes block 735 to move forward, release tab 760 shaft 753 runs along the shallow parallel side walls 751*a*, 751*b* of horizontal slot 751. When fin 716 is ejected from fin compartment 715, the user adjusts tab end 752 so that is latched into ball slot 753*b* so that the tab end 752 does not move, and consequently the fin 716 locks in the ejected position for swimming.

Figure 5A:
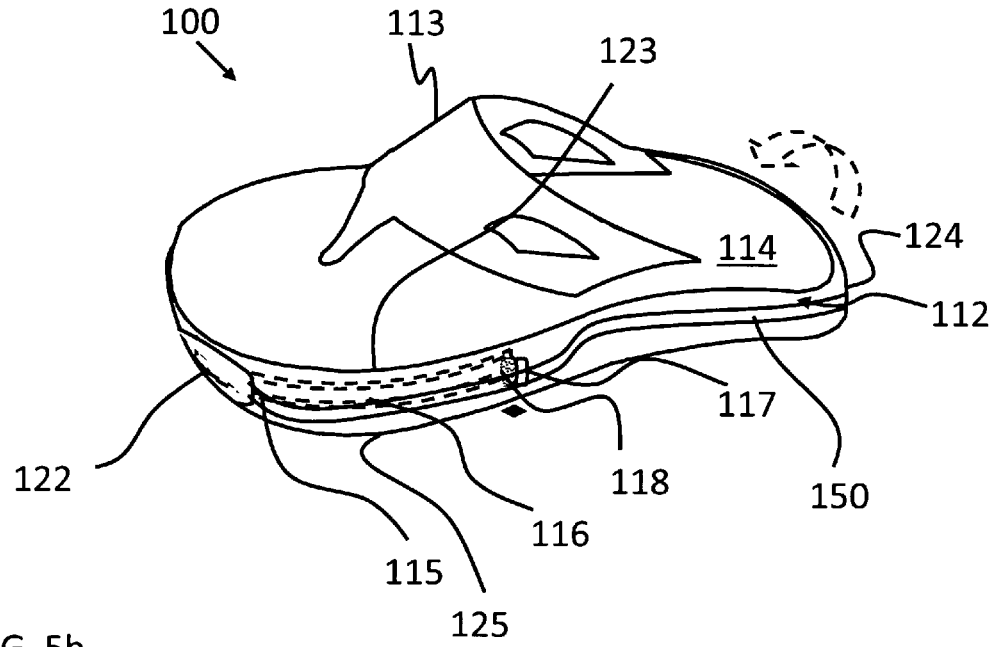
FIG. 5*a* shows a top view of another embodiment of the amphibious water shoe wherein the shoe is a sandal or flip-flop and wherein the stabilization means is provided as a fin strap.
Figure 5B:
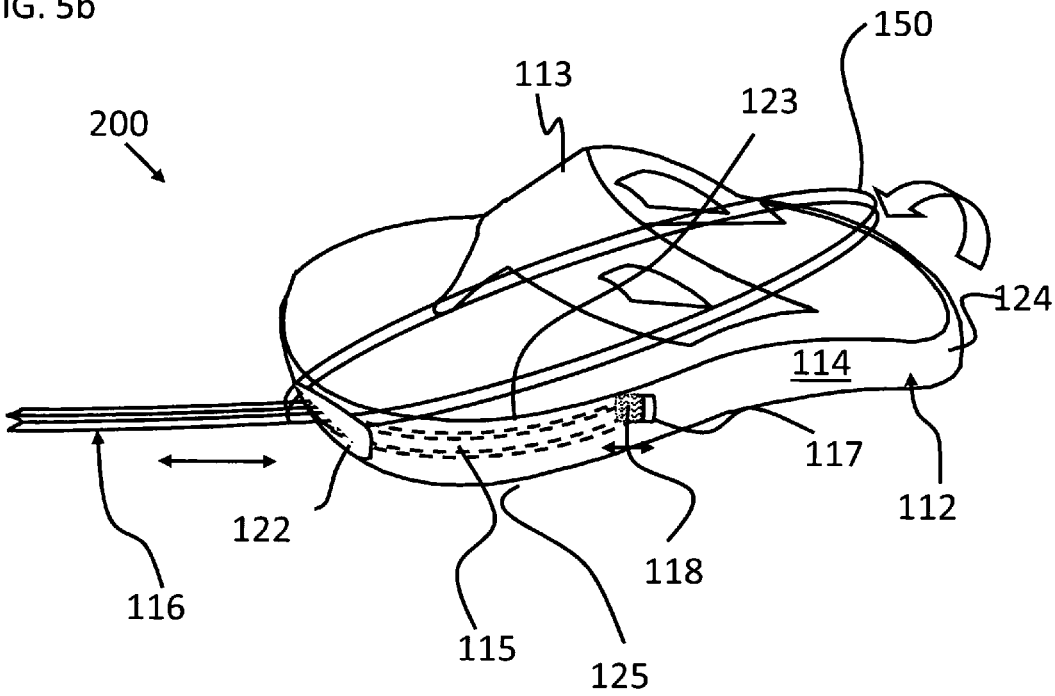
FIG. 5*b* shows a top side view wherein the fin is in the ejected position and in the compact configuration.
Figure 5C:
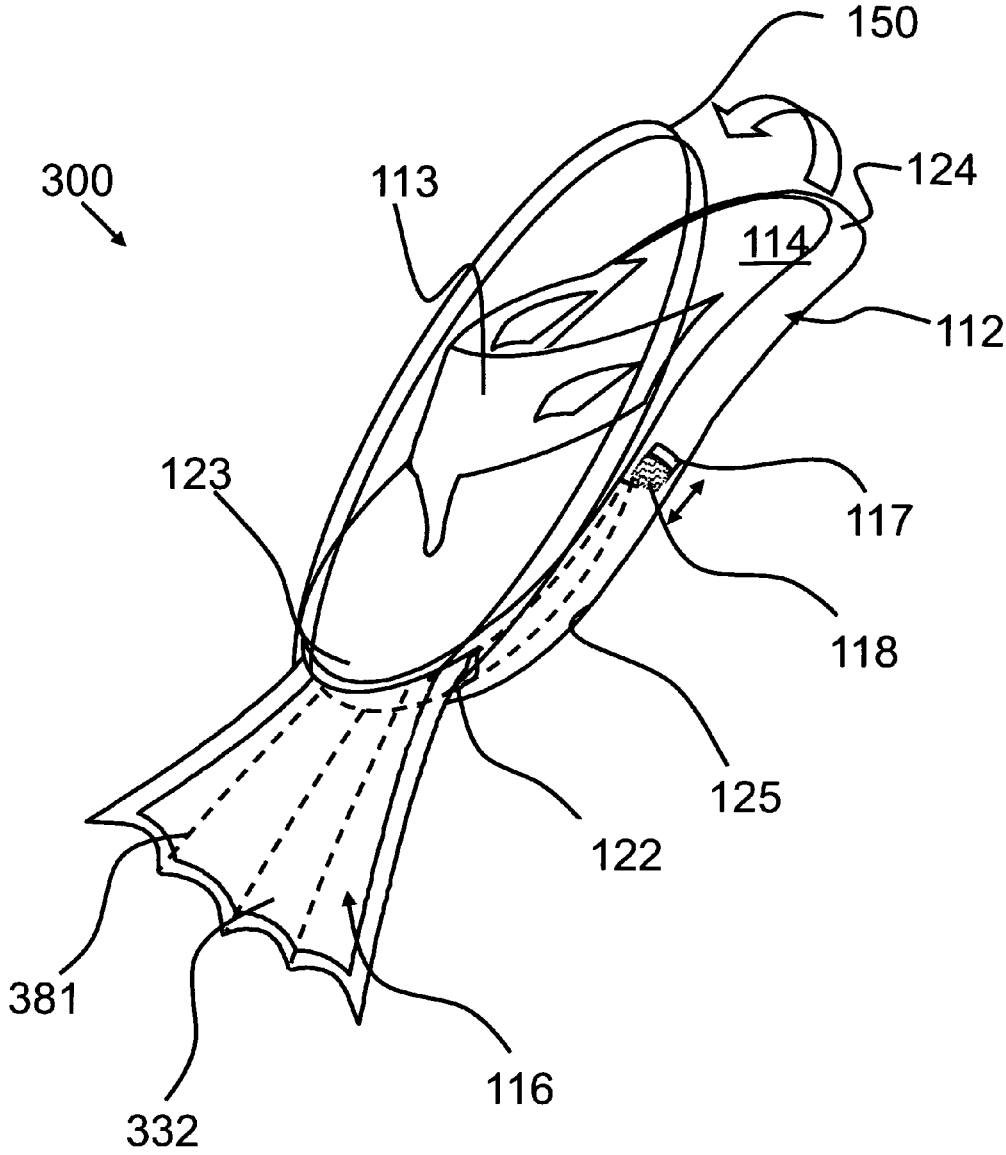
FIG. 5*c* shows a top side view wherein the fin is in the ejected position and in the fan configuration.

FIGS. 5*a*-5*c* illustrate another embodiment of the amphibious shoe as shown in FIGS. 1*a*-1*c*, however, herein the shoe comprises a sandal or flip-flop and the pivotal stabilization strap assembly is shown in an alternative embodiment wherein it is attached to a front portion of the shoe and extends around a peripheral of the sole so that the pivotal stabilization strap is rotated upward to rest behind a heel of the wearer's foot. Particularly: FIG. 5*a* illustrates a top side view wherein the fin is in the retracted position being housed within the fin compartment of the sole, shown generally at 100; FIG. 5*b* illustrates a top side view wherein the fin is in the ejected position and in the compact configuration, shown generally at 200; and FIG. 5*c* illustrates a top side view wherein the fin is in the ejected position and in the fan configuration, shown generally at 300. Amphibious shoe 111 comprises a shoe 112, herein shown as a sandal/flip-flop, with a shoe housing structure 113, herein shown as a strap, and a sole 114 constructed with a fin aperture 122, top wall 123, back wall 124, and a bottom wall 125 constructed to form a fin compartment 115 integrated therein housing a fin 116 in a retracted position. Fin 116 is associated with a release button 117 in communication with a spring tension 118 and comprises ridges 381 intermittent between a material 332 arranged in an accordion construction so that fin 116 is capable of being expanded to a fan configuration as shown in FIG. 5*c* and compressed to a compact position as shown in FIGS. 5*b* and 5*a*. A pivotal stabilization strap assembly 150 is pivotally attached to a front portion of shoe 112 and extends around a peripheral of sole 114 so that pivotal stabilization strap 150 is rotated upward to rest behind a heel of the wearer's foot. Stabilization strap 150 is appointed for holding fin 116 in place on a wearer's foot behind the heel, thereby anchoring the shoe securely on the foot. Pivotal stabilization strap assembly 150 is preferably composed of an elastic strap or band with a tension setting buckle for tension adjustment behind the heel of the wearer's foot. Pivotal stabilization strap assembly 150 is attached to sole 114 proximal to fin aperture 122 to fully anchor shoe 112 on the wearer's foot by fully leveraging fin 116 on shoe 112 as against the wearer's heel.

Figure 6A:
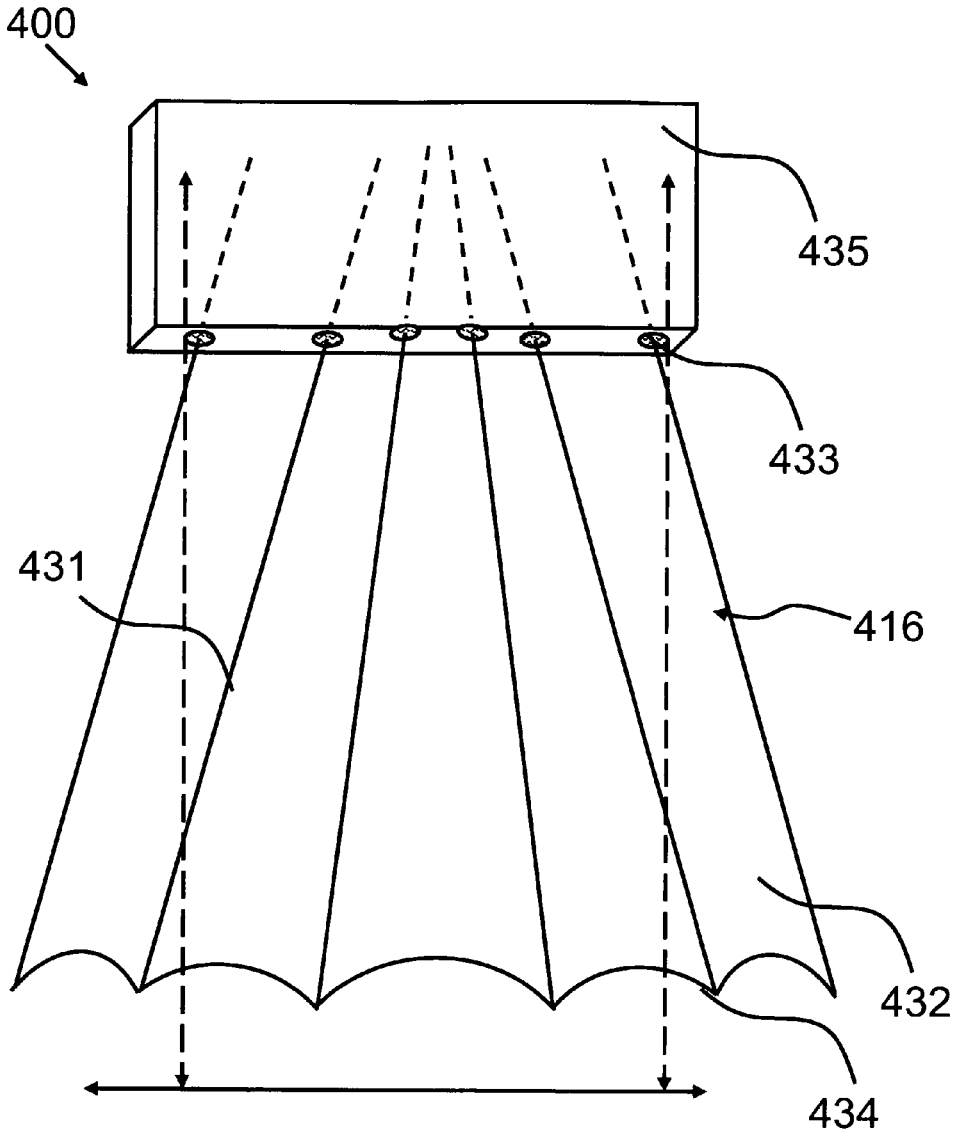
FIG. 6*a* is a top view of an embodiment of the fin.
Figure 6B:
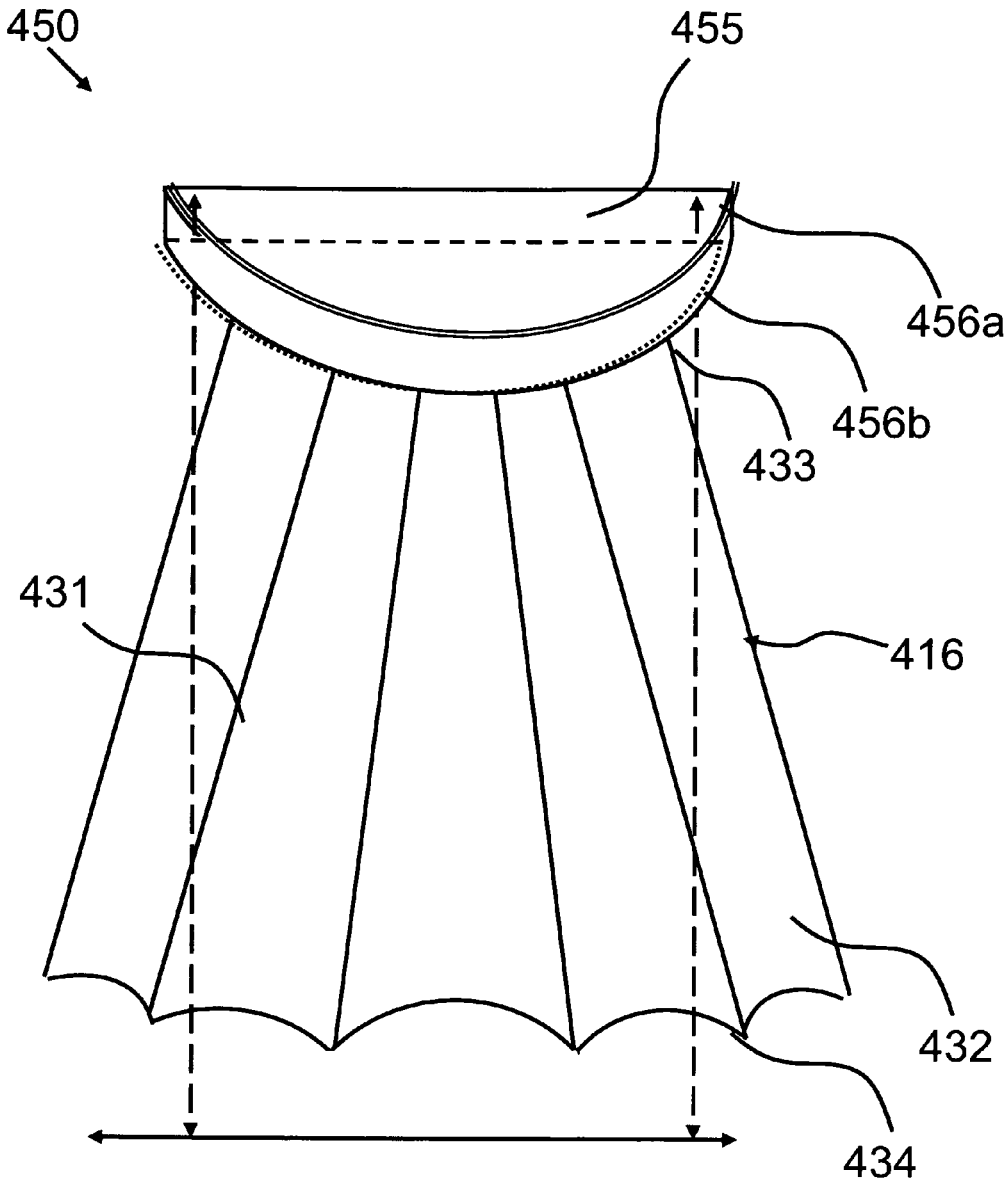
FIG. 6*b* is a top view of another embodiment of the fin.

FIGS. 6*a* and 6*b* illustrate perspective views of the fin of the amphibious shoe, shown generally at 400, and 450, respectively. Fin 416 is comprised of a flexible mesh material 432 located between ridges 431. Ridges 431 include a proximal end 433 and a distal end 434. Proximal end 433 traverses into block 435 (FIG. 6*a*)/arced block 455 (FIG. 6*b*). Ridges 431 operate to automatically expand or fan out, when block 435/arced block 455 moves forward within the fin compartment to release fin 416 therefrom. In FIG. 6*b*, arced block 455 has the shape and contour of the front of the shoe (i.e. toe area) for a flush configuration with the fin aperture so that water entry into the fin compartment during swimming is mitigated. Block 455 may include a rubber gasket 456 (456*a* on a top rim of block 455 and 456*b* on a bottom rim of block 455) to further provide a substantially water tight fin compartment during swimming.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An amphibious shoe, comprising:

a. a shoe having a sole including a fin aperture, top wall, back wall, and a bottom wall constructed to form a fin compartment integrated therein;

b. a fin being housed within said fin compartment in a retracted position and being adapted so that a portion of said fin can be released from said fin compartment through said fin aperture of said sole to yield an ejected position;

c. said fin comprising ridges intermittent between a material and arranged in an accordion construction so that said fin is capable of being expanded to a fan configuration, and wherein said fin is capable of being compressed from said fan configuration to a compact configuration when said fin is appointed to be retracted back into said fin compartment in said sole;

d. a pivotal stabilizing strap assembly appointed for holding said fin in place on a wearer's foot that operates to pivot and rest against said wearer's foot to provide enhanced stability of said fin and said shoe during swimming;

e. said fin being associated with a sliding release tab that enables removal of said portion of said fin from said fin compartment through said fin aperture of said sole to yield said ejected position; and f. said sole of said shoe including a tab slot comprising shallow parallel walls having a debris shield for mitigating entry of debris within said tab slot.

2. An amphibious shoe as recited by claim 1, wherein said ridge is composed of metal.

3. An amphibious shoe as recited by claim 1, wherein said ridge is composed of polymeric material.

4. An amphibious shoe as recited by claim 1, wherein said ridge has a thickness ranging from 0.02 inches to 0.25 inches.

5. An amphibious shoe as recited by claim 1, wherein said material is composed of a lightweight mesh material.

6. An amphibious shoe as recited by claim 1, wherein said material is composed of a lightweight thin rubber sheet material.

7. An amphibious shoe as recited by claim 1, wherein said sole of said shoe has a thickness ranging from 0.25 inches to 3 inches.

8. An amphibious shoe as recited by claim 1, wherein said sole of said shoe comprises a transitional cushion located within said top wall of said sole above said fin compartment.

9. An amphibious shoe as recited by claim 1, wherein said pivotal stabilization strap assembly is pivotally attached to a front portion of said shoe and operates to pivot and rest against a top part of said wearer's foot.

10. An amphibious shoe as recited by claim 1, wherein said pivotal stabilization strap assembly comprises a tension mechanism.

11. An amphibious shoe as recited by claim 1, wherein said pivotal stabilization strap assembly is pivotally attached to a front portion of said shoe and operates to rotate backward to rest against a top bridge of said wearer's foot.

12. An amphibious shoe as recited by claim 1, wherein said pivotal stabilization strap assembly is pivotally attached to a front portion of said shoe and extends around a peripheral of said sole so that said pivotal stabilization strap is rotated upward to rest behind a heel of said wearer's foot.

13. An amphibious shoe as recited by claim 12, wherein said pivotal stabilization strap assembly is composed of an elastic strap with a tension setting buckle for tension adjustment behind said heel of said wearer's foot.

14. An amphibious shoe as recited by claim 12, wherein said pivotal stabilization strap assembly is attached to said sole proximal to said fin aperture.

15. An amphibious shoe as recited by claim 1 comprising an aperture cover covering said fin aperture appointed to be opened to access said fin aperture when getting ready for ejecting said fin.

16. An amphibious shoe as recited by claim 1, wherein said fin being housed within said fin compartment in said retracted position is accessible through said fin aperture so that access to said portion of said fin is provided for removal of said fin from said fin compartment through said fin aperture of said sole to yield said ejected position.

* * * * *